United States Patent [19]

de Clara

[11] 4,236,533

[45] Dec. 2, 1980

[54] NOVEL CIGARETTE PROCESS AND PRODUCT PRODUCED THEREFROM

[75] Inventor: Maximilian de Clara, Munich, Fed. Rep. of Germany

[73] Assignee: TKR Tabak Forschnugs-GmbH & Co., Munich, Fed. Rep. of Germany

[21] Appl. No.: 29,857

[22] Filed: Apr. 13, 1979

[51] Int. Cl.[3] ..... A24B 15/28

[52] U.S. Cl. ..... 131/17 R; 131/140 B

[58] Field of Search ..... 131/17 R, 140 B, 140 C, 131/140 R

[56] References Cited

U.S. PATENT DOCUMENTS

| | | | |
|---|---|---|---|
| 3,348,553 | 10/1967 | Huber et al. | 131/194 |
| 3,474,792 | 10/1969 | Miller et al. | 131/17 R |

*Primary Examiner*—V. Millin

*Attorney, Agent, or Firm*—Leonard W. Sherman

[57] ABSTRACT

A novel smoking composition is provided by treating tobacco with an active agent comprising a mixture of auric oxide, silver nitrate or sulfate, platinum tetrachloride and cerium (III) salts selected from the group of carbonates, sulfates and nitrates in an effective amount to reduce a substantial percentage of polycyclic aromatic hydrocarbons, nicotine and raw condensate in the tobacco smoke.

9 Claims, No Drawings

NOVEL CIGARETTE PROCESS AND PRODUCT PRODUCED THEREFROM

BACKGROUND OF THE INVENTION (1) Field of the Invention

This invention relates to a novel tobacco composition and to the process for the treatment of smoking tobacco for cigars, cigarettes and/or tobacco or pipes and to other smoking products made with tobacco.

(2) Description of the Prior Art

It has long been known that a large number of products of combination found in tobacco smoke are toxic. Included among these undesirable tobacco smoke components are polycyclic aromatic compounds and their heterocyclic analogs. The highly carcinogenic effect of some polycyclic aromatic hydrocarbons is well-documented. (Smoking and Health, Report of the Advisory Committee to the Surgeon General, U.S. Public Health Publication No. 1103, Ch. 9, p. 142–146 (1963)) A specific polycyclic aromatic compound which merits special attention is benzo(a)pyrene (occurs as 1,2-benzopyrene; also referred to as 3,4-benzpyrene and benzo(e)pyrene and 4,5-benzopyrene), since it is generally present in proportionately higher quantities and has long been known to be a potent carcinogenic agent.

In an effort to lower the polycyclic aromatic hydrocarbon content of tobacco smoke, a host of various treatments of tobacco materials have been proposed in the art. For example, the addition of nitrates and nitrites to tobacco has been previously described in patents and in published literature. For example, French Patent No. 1,180,320 teaches the addition of nitrites to tobacco and cigarette paper to reduce the polycyclic aromatic hydrocarbon yield. U.S. Pat. No. 3,121,433 describes the addition of potassium nitrate to reconstituted tobacco sheet to improve its burning characteristics. U.S. Pat. No. 3,180,458 teaches the addition of potassium and sodium nitrate to tobacco and it discloses a reduction of cigarette tar yield which is caused by the increased burn rate of the cigarette. Huntley and Bergun (Analyst, volume 85, p. 727–730 (1960)) describe the addition of copper and potassium nitrates to reduce the yield of 3,4-benzopyrene from the cigarette smoke.

The treatment of tobacco compositions with platinum group metals such as platinum, palladium, rhodium, osmium, iridium or ruthenium to lower the concentration of active carcinogens such as benzopyrene in tobacco smoke is disclosed in British Patent No. 841,074.

Another approach suggested to reduce polycyclic aromatic compounds involves the use of zeolite molecular sieve compositions. For example, U.S. Pat. No. 3,292,636 discloses tobacco preparations in combination with crystalline zeolite molecular sieves such as L, X, Y, or synthetic mordanite types or naturally occuring fraujasite materials, which sieves may contain any metal containing a vapor pressure below one atmosphere at 1000° C. and possessing catalytic activity for organic conversion. U.S. Pat. No. 3,572,348 also relates to a smoking preparation comprised of a zeolite material which effects a decrease in the amount of polycyclic aromatic compounds produced from the combustion of tobacco. This zeolite material is of the Y-type structure and is at least partially exchanged with zinc ion or containing metalic palladium or at least partially exchanged with zinc ions and containing metallic palladium, or is partially polyvalent zinc cation exchanged and partially decatonized and contains metallic palladium. U.S. Pat. No. 3,703,901 also discloses a Y-type zeolite structure at least partially exchanged with zinc ions and containing platinum or silver for reducing the amount of polycyclic aromatic compounds in tobacco smoke.

The use of cerium sulfate together with compounds of titanium, zirconium and tin to remove nicotine from tobacco smoke has been proposed in German Patent No. 640,193.

As indicated by the above prior art, a concerted effort has been expended to reduce deliterious substances in tobacco smoke. However, these treatments suffer various shortcomings and have not had a degree of commercial success. Therefore, any method or improvement for decreasing substantial amounts of polynuclear aromatic hydrocarbons especially benzo(a) pyrene in tobacco, which would produce a commercially feasible product, would appear to be highly desirable and beneficial. Ideally a method which can be applied or used in a continuous process compatible with existing manufacturing techniques thereby adding no appreciable cost to the production expense of the tobacco product is most desirable. Furthermore, the novel tobacco product produced therefrom should not adversely affect the taste or aroma of the tobacco smoke. The present invention fulfills all these aforementioned goals.

SUMMARY OF THE INVENTION

The present invention relates to a novel tobacco smoking composition which comprises tobacco and an active agent comprising a mixture of auric oxide, silver nitrate, or sulfate platinum tetrachloride and a cerium (III) salts selected from the group of carbonate, sulfate and nitrate in an effective amount to reduce a substantial percentage of polycyclic aromatic hydrocarbons especially benzo (a) pyrene, nicotine and raw condensate content in the tobacco smoke and the process for making this novel smoking composition.

While the present invention has applicability to the treatment of any gas stream containing carcinogenic hydrocarbons, it will be described most particularly with respect to tobacco smoke.

It is an object of the present invention to provide a chemical additive for tobacco which will substantially eliminate certain deliterious substances normally found in the products of combustion when the tobacco is burned.

Another object of this invention is to disclose a tobacco mixture containing a chemically active agent for reducing benzo(a)pyrene and other deliterious materials produced when the tobacco is burned.

Still another object of this invention is to disclose a non-toxic chemical additive for tobacco which will decrease the amount of carcinogenic components to be found in the tars of the smoked tobacco, yet will not produce toxic materials themselves while reducing the harmful hydrocarbons and the combustion products of the tobacco.

Still another object of this invention is to disclose a cigarette which produces less benzo(a)pyrene and less raw condensate when the tobacco is smoked.

A further object is to provide a process of treating tobacco with a chemical active agent for decreasing the amount of certain deliterious products produced when the tobacco is burned.

A still further object of this invention is to disclose a process for producing a cigarette which when smoked produces a minimum of benzo(a)pyrene, raw condensate and nicotine.

These and further objects and advantages of this invention will be more apparent upon reference to the accompanying detailed description, specific examples and claims.

DETAILED DESCRIPTION OF THE PREFERRED EMBODIMENTS

In accordance with the present invention it has been found that a certain combination of chemical compositions when added to tobacco substantially reduces a portion or percentage of benzo(a)pyrene and the raw condensate which are produced when the tobacco is burned in a cigarette. The discovery that the unique combination of these chemical substances would reduce the benzo(a)pyrene and the raw condensate content was quite unexpected since various compounds that are similar have been ineffective for this purpose.

The chemical active agents contemplated by this invention can be incorporated into the tobacco in any desirable manner. For example, solutions of the chemically active agent in a suitable solvent, such as water, can be applied to the tobacco by spraying, soaking, sprinkling or the like after which the solvent is driven off as a vapor leaving the additive thoroughly incorporated with the tobacco. The active agent can also be applied as a finally-divided material to a dusting, shaking or dispensing medium of any suitable type which will uniformly disperse the additive over the tobacco. The incorporation of the active agent may take place at any time prior to the final packaging of the tobacco product. In the case of cigarette tobacco, it may be incorporated before or after blending of the various tobaccos if, in fact, blended tobacco is employed and the additive may be applied to one or all of the blend constituents. The mixture of chemical substances should be well-dispersed through the tobacco so that it will be uniformly effective during the entire smoke.

The amount of active agent in the final product contemplated by this invention to effectively reduce the benzo(a)pyrene and raw condensate is quite small. Generally, desirable reduction of these deliterious substances can be obtained if the active agent mixture is incorporated into the final tobacco product in amounts between about 0.1 and 10 weight percent, preferably 0.5 to 5 weight percent and most preferably 1 to 5 weight percent in reference to the total weight of the tobacco.

The active chemical agent additive is a mixture comprising:

(a) 75–99 weight percent of a cerium III salt selected from carbonates, nitrates and sulfate;

(b) 0.5–20 weight percent of silver nitrate or sulfate;

(c) 0.1–10 weight percent auric oxide; and (d) 0.05–5.0 weight percent platinum tetrachloride.

Preferred ranges: cerium (III) salt 85-99 weight percent; silver nitrate or sulfate, 0.5-5 weight percent; auric oxide, 0.5–5 weight percent and 0.1–1.0, platinum tetrachloride. Most preferred ranges: cerium (III) salt; 95–99, silver nitrate or sulfate, 1–5 weight percent; auric oxide, 0.5–1.5 weight percent and platinum tetrachloride, 0.1–0.5 weight percent. All the percentages are based on the dry tobacco containing the conventional amount humidity.

Preparation of Tobacco Samples

The experiments were carried out with tobacco from two brands of commercial cigarettes.

The commercial cigarettes were carefully ripped by a special machine and the tobacco was collected and stored at a temperature of +4° C. Packed fine-cut tobacco, pipe and cigar tobacco and tobacco leaves were not used. Tobacco in commercial cigarettes is more homogeneous than the other types of tobacco mentioned and thus the quality of the experimental cigarettes can be assured by comparing them with original commercial cigarettes.

A solution of the chemically active agent mixture was prepared by dissolving 100 grams of cerium (III) nitrate, 073 grams auric oxide, 2 grams silver nitrate and 0.35 grams of palladium tetrachloride in 5 liters of water. This volume of chemical active agent is sufficient to treat 16 kilograms of tobacco.

The treatment substances were sprayed on the tobacco in a drum mixer. When the spraying was completed, mixing was continued for about two minutes before the tobacco was removed from the drum. The treated tobacco (46 weight percent water) was placed on a drying hurdle and for two days was dried with repeated turning to a moisture content conventionally used in cigarette making (11 to 13 weight percent water). After this drying step the tobacco was filled into plastic bags and stored for one or two days to obtain uniform distribution of the residual moisture.

The tobacco not treated with the chemical active agent of the present invention was subjected to the same treatment except that distilled water was used instead of the treatment solution.

Cigarette Making

Cigarettes were produced from the treated and untreated tobacco batches. To ensure that there would be a minimal or no influence on the test results by the cigarette paper and adhesive, all samples were manufactured using Pela 40MC cigarette paper (Schoeller and Hoesch) and an adhesive marketed as Dextraco11DH 4030 (Sichel Werke GmbH, Hannover, Germany) to glue the cigarette paper together. Each manufactured cigarette was then checked for size, i.e. diameter, puff resistance and weight. The diameter of the cigarettes was 8.0 plus or minus 0.1 millimeter as measured by a ring gauge for non-destructive measurement of circumference and diameter of the sample cigarettes. The puff resistance was determined separately for each cigarette. Emperical values of puff resistance were obtained from measurements of corresponding commercial cigarettes and was measured as the pressure drop occuring while air is being sucked through the cigarette using a puff volume of 35 mls at an air flow velocity of 17.5 centimeters cubed per second at a temperature of 20° C. and a pressure of 1.01 (760 millimeters). These measurements reflect on the packing density of the tobacco. Accordingly, values between 3 and 4 millimeter water gauge were acceptable since they corresponded to values obtained with commercial cigarettes.

The cigarettes were then machine smoked in accordance with DIN Specification 10240, using the RM 20/CS smoking machine manufactured by Borgwald, Hamburg, Germany. The puff duration was two seconds, the puff volume 35 milliliters and the puffing rate one puff in 60 seconds. The puff profile was bell-shaped, and the butt length was adjusted to 23 millimeters. In addition, the number of puffs per cigarette was measured in order to obtain information about the burning properties of the cigarette.

Prior to testing the experimental cigarettes were stored at a temperature of 22° C. and 60% relative humidity for a period of 72 hours.

Analysis of Tobacco Smoke

Smoke condensate collection and subsequent analysis were carried out according to DIN Specification 10240, parts 1 to 3, i.e., conditioned cigarettes were machine smoked and the condensate collected on conditioned glass -fiber filters of known weight. The condensate volumes were determined by comparing the weights of the filters before and after machine smoking. The filters bearing the raw condensate were left in a desicator at a controlled atmosphere (22° C.±1° C.) until constant weight was achieved. This generally took 72 hours. The dry condensate content percent weight was then calculated from the total number of cigarettes smoked and the weight difference.

The nicotine content of the tobacco smoke condensate was dissolved in methanol and determined in accordance with DIN Specification 12242. After a two-stage water vapor distillation, the nicotine content of the distillate was measured spectrophotometrically. The analytical procedure for benzo(a)pyrene involves about 300 to 400 milligrams of freshly collected tobacco smoke condensate taken from the glass-fiber filters or the electrostatic smoke trap and poured over a cellulose acetate column together with 20 to 30 ml ethyl alcohol. cellulose acetate column is prepared by mixing 30 g cellulose powder with ethyl alcohol to give a thin-bodied homogeneous paste which is filled into a chromatographic tube sealed with glass wadding. After the powder has settled (filling height about 40 cm) and the ethyl alcohol has been drained, the column is eluted with 100 ml benzene at 3 bar (nitrogen). Subsequently the benzene is driven out again by the residual ethyl alcohol. A column prepared in this way can be used for a large number of experiments. When the sample has soaked into the column, the column is eluted with ethyl alcohol at 3 bar (nitrogen). The eluate (300 ml) is discarded. Eluation is repeated with benzene with the irregular penetration front clearly visible. The eluate (120 ml), has a light-yellow color, is then concentrated to about 2 ml in a tapered flask at vacuum and at a maximum temperature of 40° C. To remove the residual benzene, the sample is mixed with 3 ml isooctane and subsequently concentrated to about 0.5 ml by flashing with nitrogen at room temperature. This sample is then carefully poured over a prepared silica gel column together with 5 ml of the eluant. A silica gel column is prepared in the following manner: a relatively large quantity of silica gel is placed on a glass frit and washed with concentrated hydrochloric acid until, using rhodanide, iron is no longer detected in the filtrate. The gel is then washed with water to remove the chloride and rewashed with methanol. After removal of the methanol in the rotation evaporator, the silica gel is left to dry at 140° C. for 12 hours. 20 g of the gel thus prepared is mixed with methanol and filled into a chromatographic tube sealed with glass wadding (filling height about 20 cm). The methanol is drained and driven out completely with benzene, which in turn is driven out by the eluant proper (cyclohexane/benzene at a ratio of 195:5). A silica gel column can be used only once. The column is then eluted with cyclohexane/benzene at a ratio of 195:5. With a ultraviolet hand lamp (excitation wavelength 365 nm) the benzo(a)pyrene is clearly visible as a blue-violet fluorescent zone. The first 45 to 50 ml of the eluate is discarded and the next fraction containing the benzo(a)pyrene has a volume of 60 ml and is colorless. The fraction containing the benzo(a)pyrene is carefully concentrated to 5 or 10 milliliters and subsequently its fluorescence spectrum in the region of 340 to 500 nm is recorded (excitation wavelength 298 nm). The spectrum shows all the important characteristics of benzo(a)pyrene (maximus at 405, 430 and 455 nm; shoulder at 410 nm). In addition, it shows a slight background and often has another maximum at 367 nm, which is possibly due to an additional aromatic substance. The maximum at 405 nm is used for quantitative evaluation.

The tobaccos used in the above described testing procedures were a German commercial blend and an American commercial blend. Samples were treated with a 2.05 weight percent solution of the unique tobacco additive of the present invention. The following data presented in TABLES I and II clearly show the unexpected and nonobvious ability of the chemical active agent in removing substantial amounts of undesirable components in tobacco smoke. The data represents an average of at least 200 determinations. Statistical evaluation of the test values has been carried out in accordance with DIN 1240.

TABLE I

| GERMAN BLEND | Raw condensate (mg) | Number of puffs | Benzo (a) pyrene (ng) | Nicotine (mg) | Weight per Cigarette (g) |
|---|---|---|---|---|---|
| UNTREATED | 31.33 | 8.75 | 27.2 | 1.43 | 0.98 |
| THIS INVENTION | 26.4 | 9.78 | 22.9 | 1.10 | 1.00 |
| Δ% | −15.7 | +11.8 | −15.8 | −23.3 | — |

The changes in raw condensate, number of puffs, benzo(a)pyrene and nicotine are highly significant.

TABLE II

| AMERICAN BLEND | Raw condensate (mg) | Number of puffs | Benzo (a) pyrene (ng) | Nicotine (mg) | Weight per Cigarette (g) |
|---|---|---|---|---|---|
| UNTREATED | 25.7 | 7.86 | 18.5 | 1.328 | 0.94 |
| THIS INVENTION | 24.0 | 7.49 | 14.9 | 1.145 | 0.94 |
| Δ% | −6.6 | −4.7 | −19.5 | −13.8 | |

The changes in raw condensate, number of puffs, benzo(a)pyrene and nicotine are highly significant.

While the above data are specific to benzo(a)pyrene, it also reflects a reduction of the other polycyclic aromatic hydrocarbons since the benzo(a)pyrene as mentioned hereinbefore is present in larger quantities than the other polycyclic aromatic components.

Other conventional tobacco additive materials such as flavorants and humectants, in addition to those described above may be used in the practice of the present invention without deviating from the scope thereof.

While the invention has been described in detail with particular reference to preferred embodiments thereof, it will be understood that variations and modifications can be effected within the spirit and scope of the invention as described hereinbefore and as defined in the appended claims.

I claim:

1. A tobacco composition comprising tobacco and an active agent comprising a mixture of auric oxide, silver nitrate or sulfate, platinum tetrachloride and cerium salts selected from the group consisting of carbonates, sulfates and nitrates in an effective amount to reduce the raw condensate nicotine and polycyclic aromatic hydrocarbons content which are normally produced by the combustion of the tobacco in the tobacco smoke.

2. A cigarette having a tobacco composition according to claim 1.

3. A cigar having a tobacco composition according to claim 1.

4. A pipe tobacco having a tobacco composition according to claim 1.

5. A process for treating tobacco to reduce the raw condensate, nicotine and polycyclic hydrocarbons which comprises contacting an effective amount of an active agent comprising a mixture of auric oxide, silver nitrate or sulfate, platinum tetrachloride and cerium salts selected from the group consisting of carbonates, sulfates and nitrates in an effective amount to reduce the raw condensate nicotine and polycyclic aromatic hydrocarbons content which are normally produced by the combustion of the tobacco in the tobacco smoke.

6. The process according to claim 5 which comprises mixing tobacco and an aqueous solution of an active agent comprising a mixture of auric oxide, silver nitrate or sulfate, platinum tetrachloride and cerium salts selected from the group of carbonates, sulfates and nitrates.

7. The process of claim 6 wherein said active agent in aqueous solution is sprayed onto said tobacco.

8. A process according to claim 5 wherein the tobacco is uncured leafs.

9. The process according to claim 5 wherein the tobacco is cured leafs.

* * * * *